US009278735B1

(12) United States Patent
Gaiser

(10) Patent No.: US 9,278,735 B1
(45) Date of Patent: Mar. 8, 2016

(54) LAUNCH AND LIFT APPARATUS

(71) Applicant: Donald Gaiser, North Fort Myers, FL (US)

(72) Inventor: Donald Gaiser, North Fort Myers, FL (US)

( * ) Notice: Subject to any disclaimer, the term of this patent is extended or adjusted under 35 U.S.C. 154(b) by 0 days.

(21) Appl. No.: 14/120,052

(22) Filed: Apr. 18, 2014

Related U.S. Application Data

(60) Provisional application No. 61/854,296, filed on Apr. 22, 2013.

(51) Int. Cl.

| | |
|---|---|
| ***B63C 3/12*** | (2006.01) |
| ***B63B 27/00*** | (2006.01) |
| ***B63C 3/06*** | (2006.01) |
| *B63B 35/71* | (2006.01) |

(52) U.S. Cl.
CPC . *B63B 27/00* (2013.01); *B63C 3/06* (2013.01); *B63C 3/12* (2013.01); *B63B 2035/715* (2013.01)

(58) Field of Classification Search
CPC ..... B63C 3/06; B63C 3/12
See application file for complete search history.

(56) References Cited

U.S. PATENT DOCUMENTS

| | | | | |
|---|---|---|---|---|
| 5,090,842 | A * | 2/1992 | Montgomery | 403/3 |
| 7,182,030 | B2 | 2/2007 | Privette | |
| 7,383,781 | B1 | 6/2008 | Griffin | |
| 8,256,366 | B2 | 9/2012 | Imel | |
| 8,381,673 | B2 | 2/2013 | Wirsig | |
| 2012/0251242 | A1 | 10/2012 | Kollar | |

* cited by examiner

*Primary Examiner* — Edwin Swinehart
(74) *Attorney, Agent, or Firm* — George DiVincenzo

(57) ABSTRACT

The kayak launch and lift apparatus, hence forth referred as the launch and lift, disclosed herein will enable the user to easily board and disembark from a kayak, a canoe or other small watercraft without many of the problems associated with existing devices. The present invention has the advantages of providing a means to stabilize the kayak, while the user is either boarding or disembarking from the kayak from a stationary dock or a sea wall. The launch and lift is made of aluminum and consists of: a pair dock loop grab rails that are bolted to the dock or sea wall, a slidable ladder, a pair of cradles that are attached to the bottom step of the ladder, a pair of bunks to support the kayak on the cradles, an additional outer grab rail that is used when boarding or disembarking from the kayak at the water level, and, a brake winch and stainless steel cable, that is used to raise or lower the kayak from or to the water level. As the water level changes due to changes in the tide or rain fall, the cradle is raised or lowered to accommodate the changes in water levels by means of a brake winch and cable. The brake winch is mounted on a platform attached to the dock grab rail and a stainless steel cable is attached to the spool of the brake winch, traverses two pulley systems welded to the side rail adjacent to the bottom step of the slidable ladder. An additional advantage of the kayak launch and lift is that it also serves as a storage device for the kayak, thus eliminating the need to store the kayak away from the launch site.

11 Claims, 5 Drawing Sheets

10

10

30

LAUNCH AND LIFT APPARATUS

RELATED US APPLICATION DATA

Provisional Application No. 61/854,296 was filed on Apr. 22, 2013.

STATEMENT REGARDING FEDERALLY SPONSORED RESEARCH OR DEVELOPMENT

This invention was made without government support.

| US Patent Documents | | | |
|---|---|---|---|
| 5,090,842 | Feb. 25, 1992 | Montgomery | 403/3 |
| 7,182,030 B2 | Feb. 27, 2007 | Privette | 114/44 |
| 7,383,781 B1 | Jun. 10, 2008 | Griffin | 114/44 |
| 8,256,366 B2 | Sep. 4, 2012 | Imel et al | 114/263 |
| 8,381,673 B2 | Feb. 26, 2013 | Wirsig | 114/362 |
| 2012/0251242 A1 | Oct. 4, 2012 | Kollar | 405/1 |

BACKGROUND OF THE INVENTION

1. Field of the Invention

The present invention relates to a kayak launch and lift apparatus attached to either a stationary dock or a sea wall that will enable the easy boarding onto or disembarking from a kayak, canoe or small watercraft.

2. Description of the Prior Art

One of the main problems with launching a kayak off a stationary dock or sea wall is the difficulty of boarding, launching and subsequently disembarking from the kayak. Very often the water level is not at the same level as the dock, and this poses difficulties for the boater to board, launch and exit from the vessel. If the kayak is not stabilized by a supportive device, it is almost impossible to board the kayak safely and effortlessly. This is especially true for both young and mature individuals. It is easy for the kayak to become unstable under these conditions and to pose safety hazards to those that are not in excellent physical condition or have well developed upper body strength. In addition, if the seas are turbulent, it is most difficult to board or exit a kayak safely under these conditions. It is also quite common, when launching a kayak from a stationary dock or sea wall, for the water level to be distant from the surface of the dock, adding to the difficulty of safely boarding and exiting the kayak. Numerous attempts have been made to overcome the difficulties of launching and disembarking from a kayak from a stationary dock, sea wall or floating dock.

U.S. Pat. No. 5,090,842 discloses a boat lift apparatus for raising and lowering that permits horizontal as well as vertical movement of the load. The lift apparatus has a load member, a lift cradle, and a lifting arrangement. The lift cradle has bearings for sliding along the rail portion of the lift cradle that can rotate to deposit the load on the dock.

U.S. Pat. No. 7,182,030 B2 discloses an apparatus for stabilizing a watercraft during boarding and exiting the watercraft comprising a pair of spaced pontoons in the water supported with watercraft supports joining the pontoons and rollers mounted on the watercraft supports. This system has the disadvantage that it is used only with a floating dock, and is not applicable to a stationary dock. Also the pontoons are relatively large and occupy considerable dock space.

U.S. Pat. No. 7,383,781 B1 discloses a boat lift system for raising and lowering a boat from and into a body of water comprising a cradle configured to hold the boat, a cable connected to the cradle, and a drive system. The cable is connected to the cradle and the drive system either raises or lowers the cradle. The primary disadvantage of the boat lift system disclosed herein is that the system must be anchored to the ground surface beneath the water and will accumulate barnacles and algae and will lead to corrosion.

U.S. Pat. No. 8,256,366 B2 discloses a boat lift for use with a canoe or kayak that is provided with guide rails on either side of the boat lift to be used by a boater to propel the watercraft on to the boat lift. In addition, the boat lift is provided with an entrance/exit assist member that can be used by boaters with impaired leg function. Also disclosed herein, is a docking system that comprises a dock and the boat lift system referenced above. The disadvantages of the boat lift disclosed above are that its use is restricted to a floating dock and cannot be used with a stationary dock or seawall.

U.S. Pat. No. 8,381,673 B2 discloses an apparatus for stabilizing a watercraft for boarding or exiting comprising an elongated cradle arm support member for attaching vertically to a dock, and a cradle arm for attaching to the cradle arm support member, in which the cradle arm has a V-shaped upper surface for cradling the under surface of the watercraft, thus restricting roll. The cradle arm is adjustable to accommodate changing water levels. One primary disadvantage of this apparatus is that the cradle arm assembly is difficult to adjust to accommodate changing water levels.

US Patent Application Publication 201/0251242 A1 discloses a retractable platform to assist kayakers to launch off an elevated boat dock. The retractable platform comprises a support frame assembly mechanically coupled to a step assembly. The support frame assembly is mechanically coupled to a platform assembly, a hand crank, a hand rail and a platform assembly. The disadvantages of this system are that the platform does not adjust easily as the water level changes and the range for the manual adjustment is only from 30.48 to 60.96 centimeters (12 to 24 inches).

SUMMARY OF THE INVENTION

Kayaks are relatively easy to launch from a beach or from shallow water. It is inevitable that one will get wet either during launching or disembarking from a kayak located in a shallow water environment. Stability and safety are also a common concern when using a kayak or canoe for it is very easy for a person to lose his balance as one's center of gravity shifts from one position to another while either boarding or disembarking from a kayak. It is even more difficult when attempting to board or disembark from a canoe or kayak from a stationary dock or sea wall. It is desirable to devise a means whereby one can safely board, launch and disembark from a kayak from a stationary dock or sea wall; and, to remain dry and safe in the process.

The present invention consists of a kayak launch and lift apparatus, hence forth referred to as the launch and lift, that is attached to a stationary dock or sea wall that achieves the desired intention of safely boarding onto or disembarking from a kayak. The launch and lift disclosed herein is particularly intended for kayaks and is also applicable to canoes and other small watercraft. This apparatus allows for the easy and safe access to and exit from a kayak that is attached to a stationary dock or sea wall. Stability and safety are never compromised.

The launch and lift is composed of a pair of loop grab rails bolted to a dock or sea wall, a slidable aluminum ladder that is attached to the loop grab rail guide member that is welded to each loop grab rail. The slidable ladder consists of two ladder side members, a ladder grab rail mounted to each ladder side rail, and a plurality of ladder steps. The rear surface of each ladder side rail is equipped with a slot or groove that is inserted over each guide member. This enables the ladder to slide up and down to adjust to varying water levels. The slidable ladder is coupled to and attached to a pair of support cradles equipped with two kayak support members or bunks to stabilize the kayak. The launch and lift adjusts manually to changing water levels by use of a brake winch that is mounted on a loop grab rail support member, and a stainless steel cable from the brake winch is attached to two u-bolt brackets welded to the back side of the bottom step of the ladder. A pulley is attached to the bottom of each ladder side rail and the stainless steel cable traverses the bottom of the ladder through the pulleys and is fastened to the bottom surface of the ladder side rail. The support cradle cap be raised or lowered in and out of the water by an attached brake winch and a stainless steel cable. The launch and lift is entirely made of aluminum that is light in weight, easy to install and occupies only 1.219 meters (4 ft) of accessible dock space. Anchor bolts secure the apparatus to the dock by two aluminum angular brackets located beneath the dock directly beneath the bolt insertion points. The bottom plate ensures that the launch and lift assembly are adequately secured to the dock. The launch and lift is simple to install and requires only 4 bolts for attachment to the dock or sea wall. The brake winch is commercially available and allows for the manual up and down movement of the cradle support members to allow easy boarding and disembarking from the kayak. The ladder grab rails and an outer grab rail ensures stability during boarding or disembarking from the kayak. One can gain access to the kayak by means of an aluminum dock rail assembly. The aluminum ladder is typically 1.52 meters (5 ft) in length is equipped with a slot machined into the back of the ladder side rail. The ladder slot traverses the entire length of the ladder. The ladder guide members are welded to each of the dock grab rails. The slot in the back of the ladder sides contain each of the ladder guide members that are welded on the exterior surface of the loop grab rails. The ladder guide members fit into the ladder slot, and, thus enable the ladder to move up or down along the ladder guide members. The kayak's two support cradles extend horizontally from the lower portion of the ladder assembly for 1.01 meters (40 inches). The proximal ends of the aluminum support cradles are attached to the bottom step of the ladder by means of U-shaped clamps and bolts. The distal end of the aluminum support cradles are welded to a pair of outer rail couplers, to which the rail is inserted, and is secured to the cradle brackets by bolts and nuts. The outer upper grab rail (for use while standing) rises vertically 0.977 meters (38% inches) from the rail coupler and is about 0.45 meters (18 inches) in width. The middle rail is welded to the middle of the vertical outer grab rails and provides support for the kayaker, while he or she is in the seated position on the kayak. Two 0.05×0.05 meter (2×2 inch) aluminum bunks are attached to the cradle supports to support the kayak when placed onto the cradles. The bunks are attached to the cradles by 4 cradle brackets. The cradle bracket is secured to the support bunks by 4 u-bolts and nuts in all for each bracket. The top surface of each of the bunks is fitted with a non-skid rubber strip that is riveted in place.

The launch and lift apparatus is to be used as a storage device for the kayak thus, avoiding the need to remove the kayak from the apparatus for off-site storage. This is particularly advantageous for commercial kayak rental operations; and, is also a convenience factor for private home use. Storing the kayak out of the water in the raised position also eliminates algae growth, barnacles, and corrosion.

When one is planning to use the kayak from the launch and lift, one simply lowers the kayak to the water level by means of the brake winch, climbs down the ladder to the kayak, uses the ladder grab rails and the upper outside grab rail for support, and lowers one's self into the kayak. One can use the ladder grab rail and use the lower outer grab rail to position one's self in the kayak and then, push off to launch the kayak. The process is used in reverse to disembark from the kayak upon returning to the dock.

With the improved design of the launch and lift disclosed herein over existing products, one has up to 1.52 meters (5 ft) of travel distance for the cradle to accommodate most tide changes. In areas where the tide changes more than 1.52 meters (5 ft), the ladder size can be increased up to 3.04 meters (10 ft) in length.

An additional advantage to the launch and lift is that age is no longer an issue, for the present invention can be used by both young and mature boaters.

DETAILED DESCRIPTION OF THE INVENTION

Figure 1:
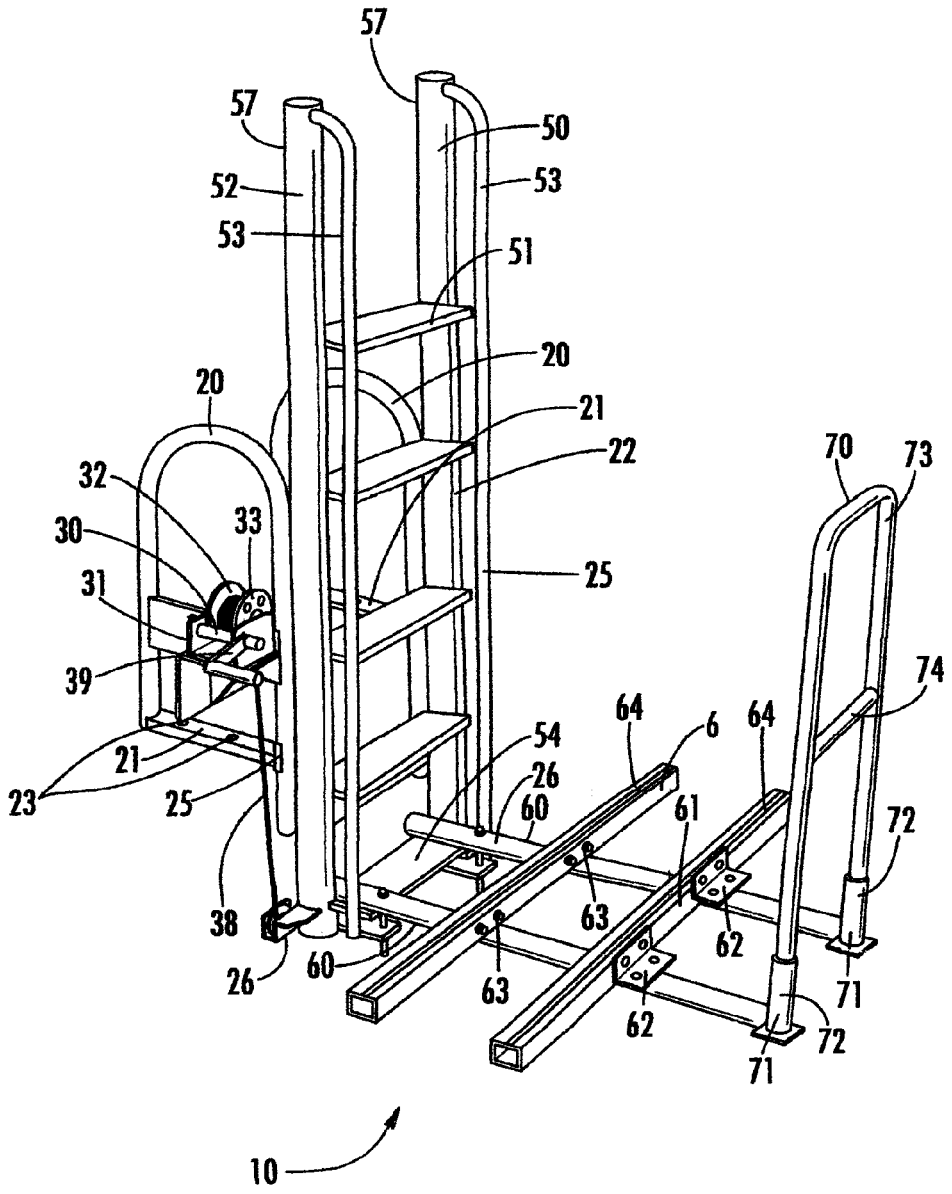
FIG. 1 is a perspective view of the kayak launch and lift apparatus attached to a stationary dock.

FIG. 1 illustrates the perspective view of the launch and left apparatus of the present invention attached to a stationary dock.

The kayak launch and lift apparatus 10 of the present invention is constructed 6000 series aluminum. The components of apparatus 10 are either welded or are mechanically attached with stainless steel hardware. i.e., bolts, nuts, flat washers and lock washers. Kayak launch and lift 10 dimensions are as follows: the dock loop grab rails are made of 1⅜ inch diameter tubular aluminum. The standard length of ladder 50 is 1.52 meters (5 ft) in length but under circumstances that require greater lengths, ladder 50 can range from 1.52-3.04 meters (5-10 ft.) in length as needed per customer specifications. Ladder side members 52 are made of 0.06 meters (2½ inch) diameter tubular aluminum. Ladder grab rails 53 are typically 1.52 meters (5 ft) in length and 3.49 centimeters (1⅜ inch) in diameter and are made of tubular aluminum. Ladder steps 51 have a textured surface for improved grip and are 10.16 centimeters (4 inches) in depth and are 45.05 centimeters (17¾ inches) wide and have turned under edges at the front of each step for additional strength. The sliding mechanism, or the grab rail ladder slide member 25, is welded securely to loop grab rail 20 and is fitted with a stop at the top and nylatron bushings at the top and bottom of 25. Member 25 is 30.48 centimeters (12 inches) in length. Loop grab rail connector 26 is attached to loop grab rail 20 and is secured to 20 by stainless steel bolts. A triangular ladder stop 58 is welded on the side surface of ladder side member 52 about 50.8 centimeters (20 inches) from the bottom of the ladder, to prevent the ladder from going any further. Kayak support cradle 60 is made of tubular aluminum and is 101.6 centimeters (40 inches) in length and extends horizontally from the bottom step of aluminum ladder 50, and, is secured to the bottom step of ladder 50 by a u-shaped clamp welded and is fastened mechanically. Outer grab rail coupler 71 is welded to kayak support cradle 60, and, outer grab rail 70 is inserted in to coupler 71 and is mechanically secured with stainless steel bolts and nuts 63. Outer grab rail 70 has two usable features. The upper section 73 of outer grab rail 70 is used when the kayaker is in the standing position preparing to board the kayak. The middle section 74 of outer grab rail 70 is used to position oneself in the kayak in preparation for launch. Kayak support bunks 61 are made of 5.08 centimeter (2 inch) square aluminum channel with a non-slip 2 inch rubber strip 64 riveted to the top surface of bunks 61. Bunks 61 are attached to kayak support cradles 60 mechanically by 2 stainless steel U-bolts, aluminum L brackets, and stainless steel bolts, flat washers, and nuts. Brake winch 30 is equipped with an appropriate length of 0.63 centimeters (¼ inch) stainless steel cable 32 that run through the pulleys housed in an aluminum U-bracket welded to each side of the bottom step 54 of ladder 50. To operate brake winch 30, turn crank handle 39 clockwise to raise the kayak and counter clockwise to release the brake and lower the kayak.

The procedure for installing kayak launch and lift 10 is straight forward, and is as follows; four holes are drilled through the dock surface, four anchor bolts 23 are inserted through the holes in dock support member 21 and through the newly drilled holes in the dock. Kayak launch and lift 10 is secured to the dock by inserting dock anchor angle bracket 24 on the under surface of the dock and fastening plate 24 to the dock with flat washers, lock washers, and nuts.

For seawall installations, drill 4 holes in concrete and insert concrete anchors, and attach kayak launch and lift with 4 lag bolts to fit into anchors.

Kayak launch and lift 10 will support kayaks up to 100 lbs in weight. Apparatus 10 is not intended to be used to lift people. One should have the kayak at water level before boarding on to, or disembarking from, the kayak.

The customary procedure for using the kayak launch and lift 10 is to first lower the kayak from the up position to the water level by means of the brake winch 30. Then climb down ladder 50 to reach the kayak. Secure your balance by using the ladder grab rails 53 and outer grab rail 70 to position yourself in the kayak and use the ladder grab rail 53 upper 73 and middle 74 sections of the outer grab rail 70 to sit in position on the kayak. Ensure that the kayak is free of the kayak support bunks 61 and push off. Upon returning to kayak launch and lift, one can disembark by reversing the above procedure.

Figure 2:
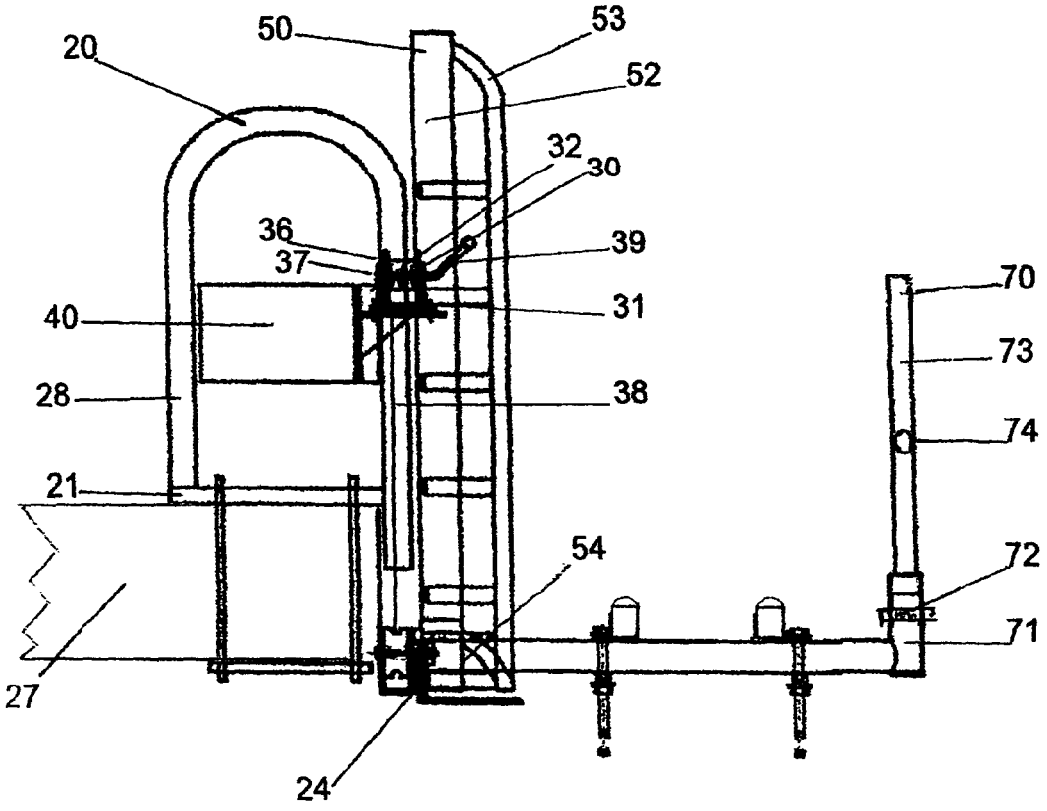
FIG. 2 is a side view of the kayak launch and lift in the up or raised position

FIG. 2 is a side view of the kayak launch and lift apparatus 10 secured to a stationary dock in the up or raised position. This figure shows loop grab rail 20 attached to the dock secured in place with dock anchor bolts 23 and dock grab rail base connector 24. Brake winch 30 is attached to the brake winch platform 31. Brake winch 30 is used to raise or lower the kayak when boarding, or disembarking the kayak, or, when storing the kayak after use in the raised position. The stainless steel cable 38 is attached to the outside of the ladder side rail adjacent to bottom step 54 of ladder 50. Step ladder 50 is typically 1.52 meters (5 ft) in length with side rail members 52 are made of 6.35 centimeters (2½/inch) tubular aluminum and steps 51 that are made of aluminum that are 10.16 centimeters (4 inches) in width and 45.08 centimeters (17¾ inches) long. Ladder 50 is also equipped with grab rails 53 for added safety. To ensure the strength and stability of ladder steps 51, the steps are constructed with turned under edges for additional strength. A stainless steel cable 38 from brake winch 30 runs through the pulleys, housed in an aluminum U-bracket, and welded to each side of the bottom step 54 of ladder 50. Two kayak support cradles 60 are secured to the bottom step of ladder 50 by a u-shaped clamp welded and fastened mechanically. Two kayak support bunks 61 are attached to support cradle 60 to provide a secure resting place for the kayak. Support bunks 61 are mechanically attached to kayak support cradle 60 by 2 stainless steel U bolts, aluminum L brackets and stainless steel bolts, flat washers, and nuts 63. A non-slip 5.08 centimeter (2 inch) rubber strip 64 is riveted to the top surface of bunks 61 to protect the kayak from damage and to enhance its grip on the kayak. Outer grab rail coupler 71 is welded to the kayak support cradle 60 at the proximal end of cradle 60. Outer grab rail 70 is inserted into coupler 71 and is held in place by bolts, nuts and washers 63. Outer grab rail 70 has an upper section 73 to aid the kayaker while boarding and disembarking from the kayak and a lower section 74 to aid the kayaker in positioning himself in the kayak.

Figure 3:
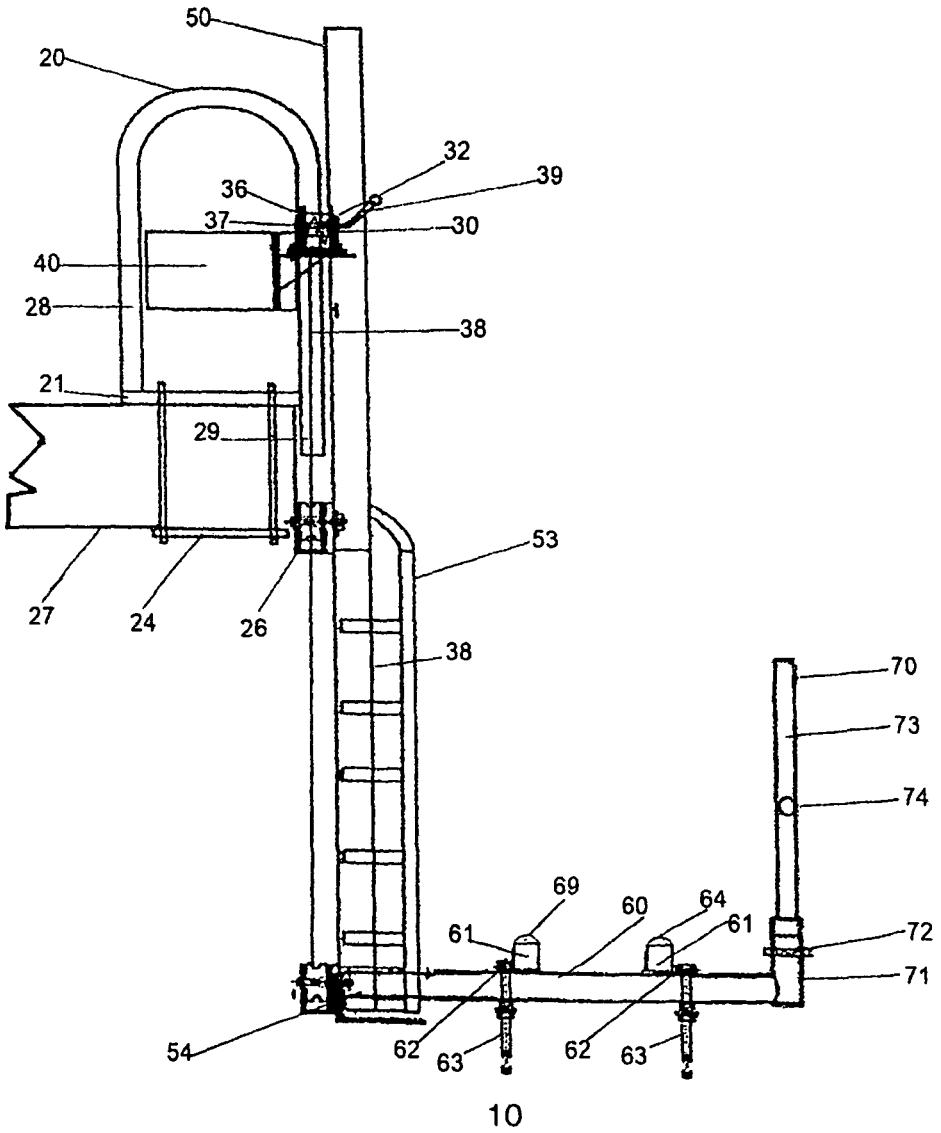
FIG. 3 is a side view of the kayak launch and lift apparatus in the down or lower position.

FIG. 3 is a side view of kayak launch and lift apparatus 10 in the down or lower position. This figure illustrates ladder 50 attached to a stationary dock 27 in the lower position. Specifically, it shows brake winch 30, brake winch handle 39, stainless steel cable 38 attached to the bottom step 54 of ladder 50, kayak support cradle 60 and kayak support bunk 61, no skid rubber strip 64 riveted to the top surface of kayak support bunks 61, cradle brackets 62 and their associated hardware 63, outer grab rail coupler 71 and outer grab rail 70. Cradle 60 is left in the raised position when the kayak is in storage or in not in use. The brake winch crank handle 39 is turned clockwise to raise cradle 60 and counter clockwise to lower cradle 60.

Figure 4:
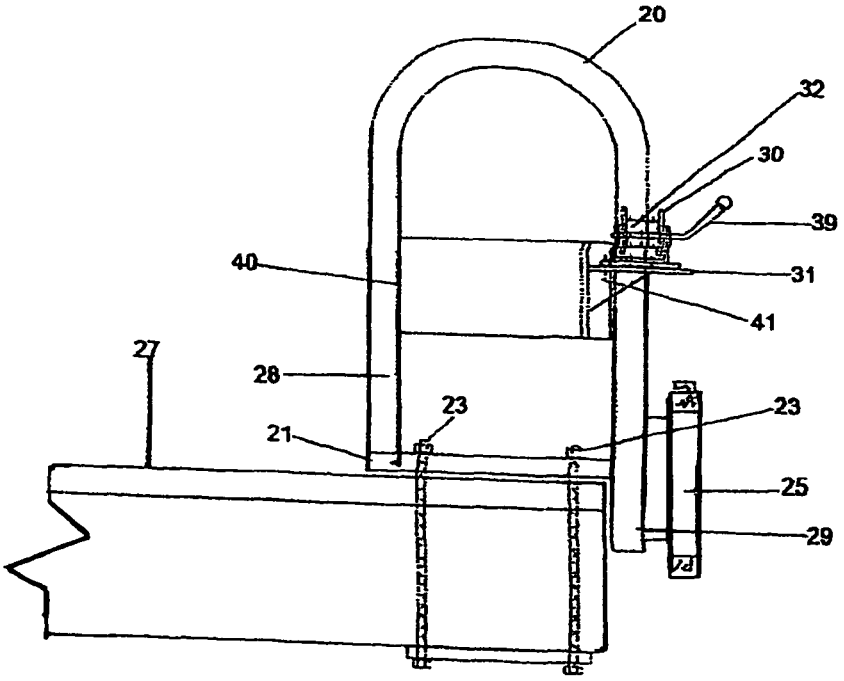
FIG. 4 is the left side view of the brake winch assembly attached to the loop grab rail assembly.

FIG. 4 is the left side view of the brake winch assembly attached to the dock grab rail assembly on a stationary dock. FIG. 4 illustrates the structure of the loop grab rail 20 that is attached to either a stationary dock 27 or sea wall. Loop grab rails 20 are asymmetrical in shape with outer rail 29 that is longer than the inner rail 28. This feature enables the loop grab rails 20 to be correctly aligned to the dock surface before the structure is anchored to dock 27 with a total of 4 anchor bolts attached to dock anchor angle bracket 24. Dock grab rail guide member 25 is welded to the outer grab rail 29 onto the exterior surface of dock grab rail 20. Brake winch 30 is welded on to brake winch anchor plate 40 and the entire unit is welded to the inner surface of loop grab rails 20. Brake winch stabilizer plate 41 is welded to the brake winch anchor plate 40 for added rigidity. The component parts of brake winch 30 are shown include brake winch platform 31, brake winch spool 32, brake winch ratchet shaft 36, retainer nut 37, and brake winch crank handle 39.

Figure 5A:
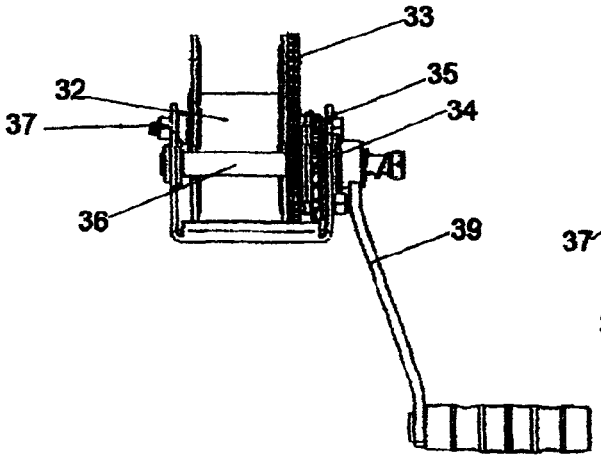
FIGS. 5A & 5B show the front and side views of the brake winch assembly showing its component parts.
Figure 5B:
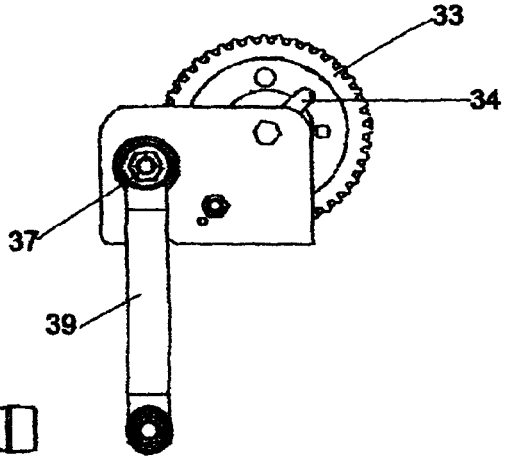

FIGS. 5A & B are front and side views, respectively, of the brake winch assembly showing its component parts. The component parts of brake winch 30 shown include: brake winch platform 31, brake winch spool 32, brake winch spool gear 33, brake winch spool ratchet brake 34, brake winch ratchet gear 35, brake winch ratchet shaft 36, retainer nut 37, and brake winch crank handle and handle grip 39. FIG. 5 B is a frontal view of the brake winch assembly. The component parts shown include the brake winch platform 31, brake winch spool gear 33, brake winch spool ratchet brake 34, retainer nut 37 and brake winch crank handle and grip 39.

What is claimed is:

1. A launch and lift apparatus mounted on a dock or sea wall to facilitate the boarding onto, launching and disembarking from a kayak comprising:

a pair of loop grab rails anchored to a dock or sea wall;

a guide member welded onto each loop grab rail;

a slidable ladder comprising a pair of ladder side rails with a slot extending the length of a rear surface of a ladder side rails with the slidable ladder being attached to the loop grab rail by means of a guide member;

a brake winch assembly to raise or lower the kayak and the brake winch assembly is mounted onto a platform that is welded to one of the loop grab rails;

a stainless steel cable attached to the brake winch assembly at one end and traverses through a pulley system mounted on the slidable ladder and is fastened to a distal end of one of the rails ladder side;

a pair of support cradles attached to the slidable ladder;

a pair of support bunks attached to the support cradles, and an outer grab rail for additional stability when boarding onto or disembarking from the kayak.

2. An apparatus of claim 1 wherein the grab rails, cradles and ladder side rails are made of 6000 series tubular aluminum.

3. An apparatus of claim 1 wherein the loop grab rails are secured to the dock by a plurality of anchor bolts placed into holes drilled through the dock surface and are further secured to the dock by dock anchor brackets on the under surface of an dock.

4. An apparatus of claim 1 wherein the loop grab rails are secured to a sea wall by a plurality of anchor bolts placed into holes drilled into the sea wall.

5. An apparatus of claim 1 wherein a pulley system is welded to each end of a bottom step of the slidable ladder and allows the stainless steel cable to travel from the brake winch assembly through the pulley located at the bottom step and the stainless steel cable is anchored by a bolt in the distal ladder side rail.

6. An apparatus of claim 1 wherein each support cradle is attached to a bottom step of each ladder side rail by an L shaped welded anchor plate and is further secured by a bolt.

7. An apparatus of claim 1 wherein the support bunks are made of 5.8×5.8 centimeter aluminum and are mounted into position onto the support cradles by a plurality of anchor clamps secured with nuts and bolts.

8. An apparatus of claim 7 wherein the top surface of each support bunk contains anon skid rubber strip riveted in position.

9. An apparatus of claim 1 wherein a outer grab rail coupler is welded to each support cradle and a U-shaped outer grab rail post is inserted into each open end of the grab rail coupler.

10. A launch and lift apparatus mounted on a dock or sea wall to facilitate the boarding onto, the launching and disembarking from a kayak comprising:

a minimum of two aluminum loop grab rails anchored to the dock or sea wall secured on the dock or sea wall by a plurality of bolts that have been inserted into the dock or sea wall and the bolts for the dock are further secured to the dock by a plurality of angle brackets located beneath the dock;

a guide member welded onto each loop grab rail equipped with bushings on each end of the guide member;

a slidable aluminum ladder equipped with a pair of ladder side rails with a slot machined into each rear surface of each ladder side rail and the slot extending nearly the length of the ladder side rail and the ladder is attached to the loop grab rails by means of a guide member;

a brake winch assembly, welded to a platform on one of the loop grab rails to raise or lower the slidable ladder;

a stainless steel cable attached to the brake winch assembly at one end and traverses through a pulley system welded to a bottom step of each ladder side rail to guide the stainless steel cable in moving the ladder up and down and the cable is fastened to one of the ladder side rails on the opposite end of the ladder side rail;

a plurality of support cradles attached to the bottom step of the ladder at one end and a grab rail coupler welded in position at the opposite end of each support cradle;

a plurality of support bunks attached to the top surface of the support cradles with cradle brackets, the top surface of each bunk has a non skid rubber strip riveted in place; and an outer grab rail that is inserted into the grab rail coupler and is fastened in place for additional stability when boarding onto or disembarking from the kayak.

11. An apparatus of claim 10 wherein the brake winch assembly consists of a platform on which the brake winch is mounted, a brake winch spool to house a stainless steel cable that is used to raise and lower the support cradle, a spool gear, a spool ratchet brake, a ratchet gear, a ratchet shaft, a retainer nut, a winch handle, an anchor plate and a stabilizer plate.

* * * * *